US006979078B2

(12) United States Patent
Ito et al.

(10) Patent No.: US 6,979,078 B2
(45) Date of Patent: Dec. 27, 2005

(54) INK-JET HEAD WITH INK BLOCKAGE PREVENTION DEVICE

(75) Inventors: Atsushi Ito, Nagoya (JP); Hisaki Sakurai, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 17 days.

(21) Appl. No.: 10/430,313

(22) Filed: May 7, 2003

(65) Prior Publication Data

US 2003/0210305 A1 Nov. 13, 2003

(30) Foreign Application Priority Data

May 7, 2002 (JP) ..... 2002-131937
Sep. 13, 2002 (JP) ..... 2002-267514

(51) Int. Cl.[7] ..... B41J 2/045
(52) U.S. Cl. ..... 347/71
(58) Field of Search ..... 347/68–72, 65, 347/92–94

(56) References Cited

U.S. PATENT DOCUMENTS 4,418,355 A * 11/1983 DeYoung et al. ..... 347/70
6,168,265 B1 1/2001 Takata
6,270,205 B1 8/2001 Takata
6,361,155 B1 3/2002 Kanda et al.
2002/0042993 A1 4/2002 Umehara
2002/0051038 A1 5/2002 Ito

FOREIGN PATENT DOCUMENTS

EP 0 695 638 A2 2/1996
EP 0 774 356 A2 5/1997
JP A 10-264377 10/1998
JP A 10-272770 10/1998

* cited by examiner

*Primary Examiner*—K. Feggins
*Assistant Examiner*—Julian D. Huffman
(74) *Attorney, Agent, or Firm*—Oliff & Berridge, PLC

(57) ABSTRACT

An ink-jet head includes a plurality of nozzles, a plurality of pressure chambers corresponding to the nozzles and connected to the nozzles, a common ink chamber for supplying ink to the pressure chambers, a supply passage for supplying ink to the common ink chamber, a plurality of connection passages corresponding to the respective pressure chambers, one ends of which are connected to the common ink chamber and the other ends of which are connected to the respective pressure chambers, a first member forming the common ink chamber, and a second member connected to the first member and having openings of the connection passages aligned in a surface at a side of the first member. A projection of an opening, positioned at a most downstream end in an ink flowing direction from the supply passage in the common ink chamber, on the first member in a connecting direction straddles a contour of the common ink chamber.

9 Claims, 19 Drawing Sheets

INK-JET HEAD WITH INK BLOCKAGE PREVENTION DEVICE

BACKGROUND OF THE INVENTION

1. Field of the Invention

The present invention relates to a structure of an ink-jet head for forming an image by ejecting minute ink droplets onto a printing surface.

2. Description of Related Art

Conventionally, as a recording apparatus which has a simple structure and enables high speed and high quality printing, an ink-jet system recording apparatus is well known.

As a ink-jet head of the ink-jet system recording apparatus, for example, an ink-jet head of a flat plate lamination structure is known which includes a plurality of nozzles for ejecting ink onto a recording medium such as a paper, a plurality of pressure chambers provided correspondingly to the respective nozzles and connected to the nozzles, a common ink chamber for distributing and supplying ink to the pressure chambers through connection passages, and a supply passage for supplying the ink to the common ink chamber.

In this structure, the ink supplied to the common ink chamber passes through the respective connection passages and is distributed to the respective pressure chambers. When ejection energy is given in the respective pressure chambers by a suitable actuator, the ink is ejected from the corresponding nozzles.

Here, for example, at the time of exchange of an ink cartridge, when air bubbles are mixed into the ink, or air having entered from the ink cartridge or the wall surface of a supply passage grows into air bubbles, and the air bubbles enter the pressure chambers or the nozzles, non-ejection of the ink is caused. Thus, a technique is known in which a purge mechanism for removing air bubbles by forcibly sucking ink in the inside of the ink-jet head from a nozzle side by a pump or the like is provided in the ink-jet recording apparatus.

The ink supplied from the ink cartridge goes via the supply passage to flow through the inside of the common ink chamber, passes through the respective connection passages, and is distributed to the pressure chambers. At this time, air bubbles are carried on the flow of the ink and are apt to collect at the end of the common ink chamber at the most downstream side. Besides, the end of the common ink chamber at the most downstream side is a place where stagnation of the ink is apt to occur, and the air bubbles generated in the ink are apt to collect, and gradually grow to be apt to impede the flow of the ink. Accordingly, as a nozzle becomes close to the end, a trouble (missing dot) of non-ejection of ink is apt to occur.

As described above, since the ink stagnates at the end of the common ink chamber at the most downstream side, the removal of the air bubbles has been difficult even by the foregoing purge mechanism. Accordingly, there has been a problem that it becomes necessary to frequently repeat the purge operation by the purge mechanism, a large amount of ink is wastefully consumed, and the running cost rises,

SUMMARY OF THE INVENTION

An object of the invention is to provide an ink-jet head in which air bubbles are not easily collected in ink at a connection portion between a common ink chamber and a connection passage, and even if they are collected, they can be easily discharged by a purge mechanism.

Another object of the invention is to provide an ink-jet head in which even if air bubbles are collected in a common ink chamber, the flow of ink is hard to block, and a trouble such as occurrence of a missing dot can be avoided.

According to a first aspect of the invention, an ink-jet head comprises a plurality of nozzles for ejecting ink, a plurality of pressure chambers provided correspondingly to the respective nozzles and connected to the nozzles, a common ink chamber for distributing and supplying ink to the pressure chambers, a supply passage for supplying the ink to the common ink chamber, a plurality of connection passages provided correspondingly to the respective pressure chambers, one ends of which are connected to the common ink chamber and the other ends of which are connected to the respective pressure chambers, a first member forming the common ink chamber, and a second member connected to the first member and having openings of the connection passages formed to be aligned in a surface at a side of the first member, wherein a projection of an opening among the openings, which is positioned at a most downstream end in a flowing direction of the ink from the supply passage in the common ink chamber, on the first member in a connecting direction straddles a contour of the common ink chamber of the first member at the most downstream end.

By this, since the opening is positioned so as to straddle the contour of the common ink chamber at the most downstream end, stagnation of ink does not occur at the end of the common ink chamber at the most downstream side. Thus, it becomes easy to discharge air bubbles in the inside of the common ink chamber.

According to a second aspect of the invention, an ink-jet head comprises a plurality of nozzles for ejecting ink, a plurality of pressure chambers provided correspondingly to the respective nozzles and connected to the nozzles, a common ink chamber for distributing and supplying ink to the pressure chambers, a supply passage for supplying the ink to the common ink chamber, a plurality of connection passages provided correspondingly to the respective pressure chambers, one ends of which are connected to the common ink chamber and the other ends of which are connected to the respective pressure chambers, wherein among the openings, an opening positioned at a most downstream end in a flowing direction of the ink from the supply passage in the common ink chamber is positioned to be spaced apart from an end of the common ink chamber at the most downstream side by at least one pitch of alignment intervals of the openings.

By this, air bubbles which could not be removed at the time of a purge operation can be collected in a portion between the end of the common ink chamber at the most downstream side and the opening. Accordingly, it is possible to prevent non-ejection of ink caused when air bubbles, which could not be removed immediately after the purge, close the opening. As a result, an interval of purge operations can be lengthened, and the amount of ink wastefully discharged by the purge operation can be decreased.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
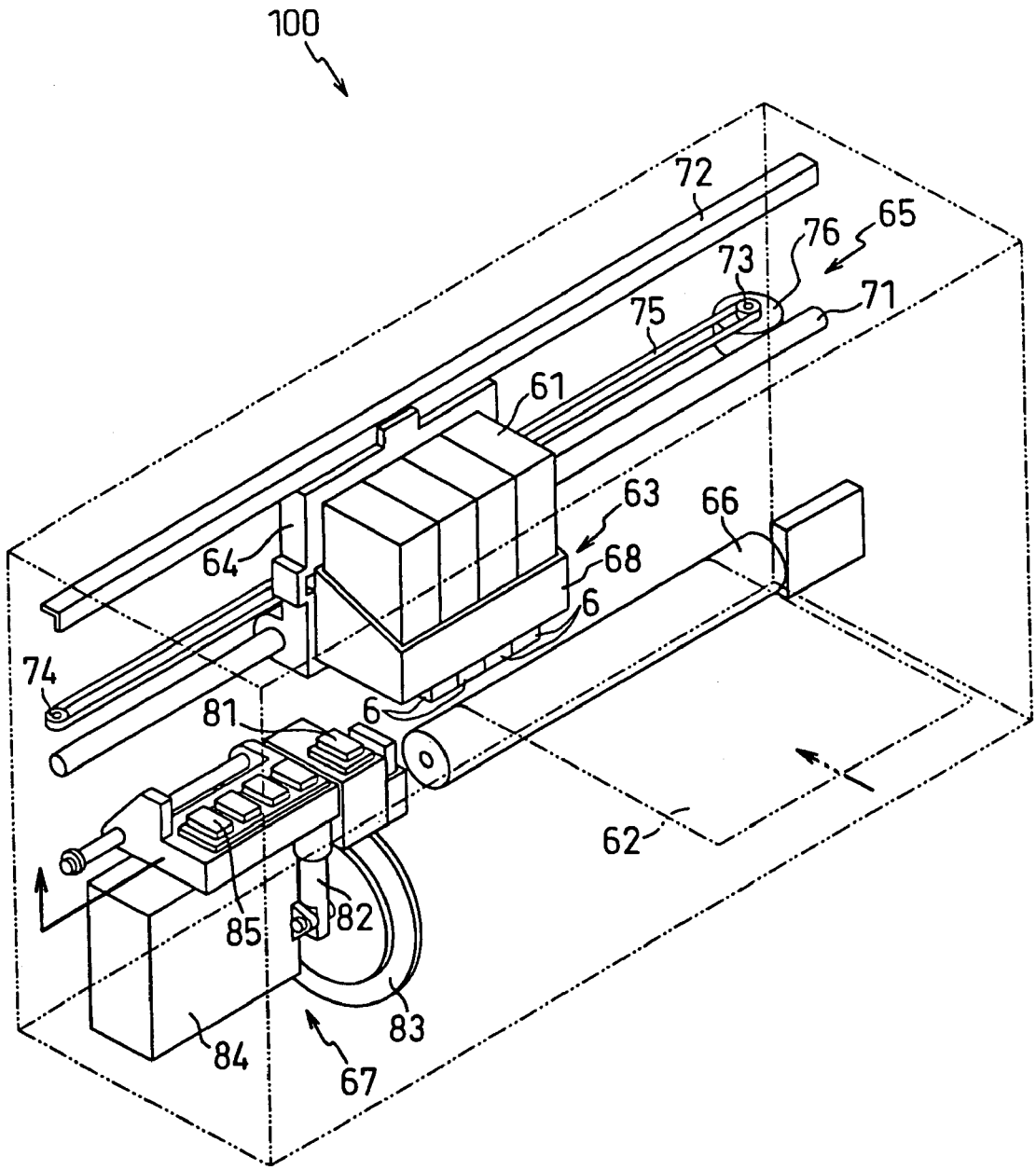
FIG. 1 is a schematic perspective view showing a color ink-jet printer to which an ink-jet head of an embodiment of the invention is applied.

In FIG. 1, four piezoelectric ink-jet heads 6 in total provided for respective colors in order to eject color inks of four colors (for example, cyan, magenta, yellow and black) are fixed to a main body frame 68 of a printer head 63 of a color ink-jet printer 100. Further, four ink cartridges 61 in which the color inks are respectively filled are detachably attached to the main body frame 68. This main body frame 68 is fixed to a carriage 64 which is reciprocated in a linear direction by a driving mechanism 65. A platen roller 66 for feeding a sheet of paper 62 is disposed so that its rotation axial line becomes parallel with a reciprocating movement direction of the carriage 64, and is opposite to the ink-jet head 6.

The carriage 64 is slidably supported by a guide shaft 71 and a guide plate 72 which are disposed to be parallel with the rotation axial line of the platen roller 66. Pulleys 73 and 74 are supported in the vicinities of both end parts of the guide shaft 71, and an endless belt 75 is stretched between the pulleys 73 and 74. The carriage 64 is fixed to this endless belt 75. The one pulley 73 is fixed to a driving shaft of a motor 76. The driving mechanism 65 is constituted by the motor 76, the pulleys 73 and 74, and the endless belt 75.

In this structure, when the one pulley 73 is forwardly and reversely rotated by the driving of the motor 76, in accordance with that, the carriage 64 is reciprocated in the linear direction along the guide shaft 71 and the guide plate 72. By this, the reciprocating movement of the printer head 63 in a main scanning direction is realized.

The sheet of paper 62 is fed from a paper supply cassette (not shown) provided at the side of the ink-jet printer 100, is sent in a sub scanning direction through a space between the ink-jet head 6 and the platen roller 66, and is ejected after a desired image is formed by ink which is ejected from the ink-jet head 6. Incidentally, in FIG. 1, the illustration of a paper feeding mechanism of the sheet of paper 62 and a paper ejecting mechanism thereof is omitted.

A purge mechanism 67 shown in FIG. 1 is for forcibly sucking and removing a poor ink including air bubbles and dust collecting in the inside of the ink-jet head 6.

This purge mechanism 67 is provided at the side of the platen roller 66. Specifically, the purge mechanism 67 is disposed at a position where it faces the ink-jet head 6 when the printer head 63 reaches a reset position by the driving mechanism 65.

The purge mechanism 67 includes a purge cap 81, and this purge cap 81 is designed to be brought into close contact with the lower surface of the ink-jet head 6 so as to cover a plurality of nozzles (the details will be described later) provided at the lower surface of the ink-jet head 6.

In this structure, when the printer head 63 is in the reset position, a state is produced in which the nozzles of the ink-jet head 6 provided to this carriage 64 are covered with the purge cap 81, and a cam 83 is driven in this state, so that the inside of the purge cap 81 is made to have a negative pressure by a pump 82. By doing so, the poor ink including the air bubbles or the like collected in the inside of the ink-jet head 6 is sucked through the nozzles and is discarded into a waste ink reservoir 84, so that the recovery of the ink-jet head 6 is performed.

By this purge mechanism 67, at the time of initial introduction of ink into the ink-jet head 6 (at the time of start of use of the ink-jet printer 100), air in the inside of the ink-jet head 6 is sucked and removed, and a passage in the inside of the ink-jet head 6 can be filled with ink. Besides, even if there occurs such a state that air bubbles grow in the passage of the inside of the ink-jet head 6 as a result of long use and the ink-jet head 6 can not eject ink, the ink-jet head 6 can be returned to a state where printing can be normally performed by carrying out the purge operation with the purge mechanism 67.

Incidentally, a cap 85 shown in FIG. 1 is for preventing drying of ink by covering the many nozzles of the ink-jet head 6 of the printer head 63 when printing is ended and the printer head 63 is returned to the reset position.

Figure 2:
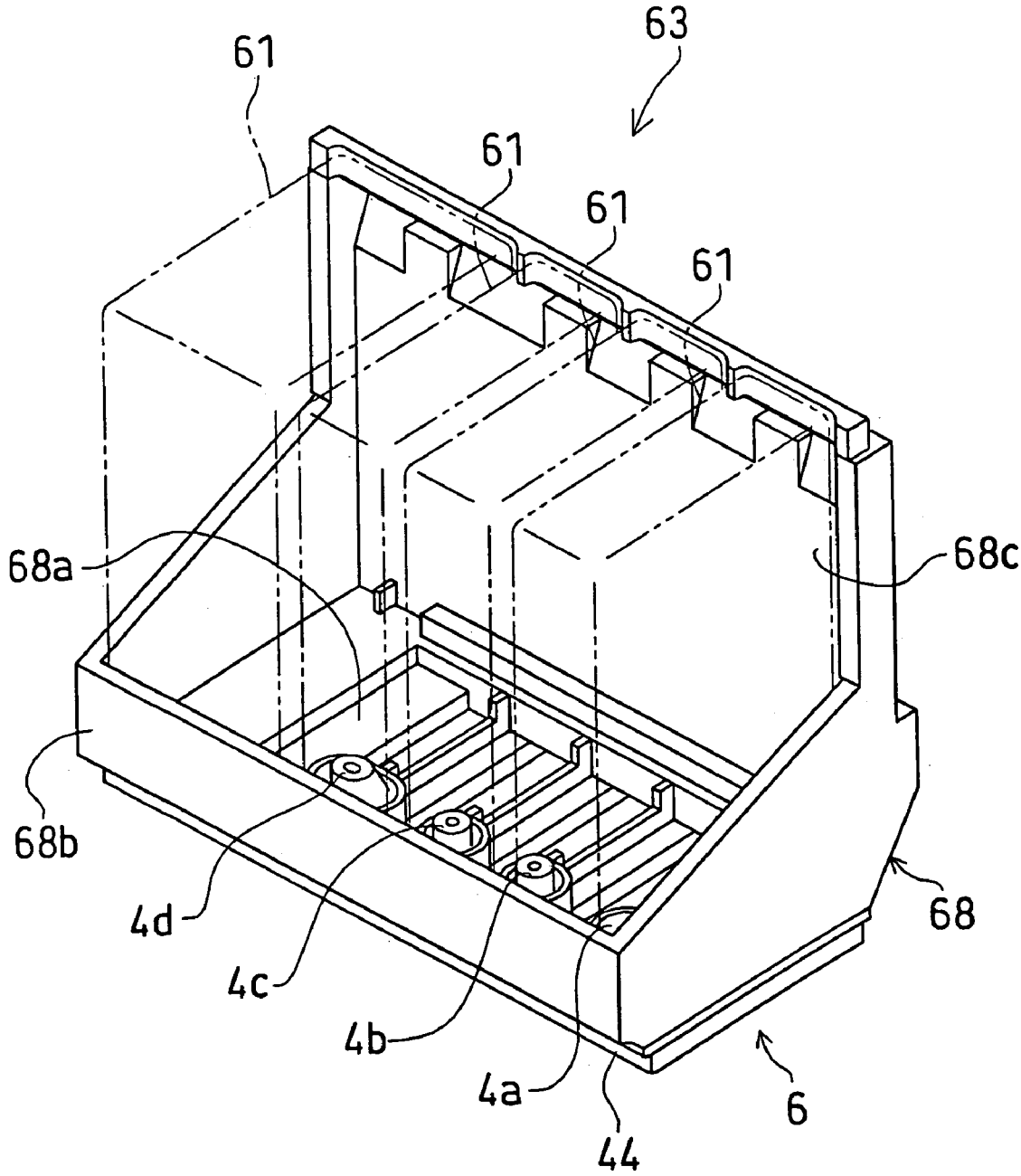
FIG. 2 is a perspective view of a printer head.

Next, the structure of the printer head 63 will be described. As shown in FIG. 1, the printer head 63 is mounted on the carriage 64 running in the direction orthogonal to the conveying direction of the sheet of paper 62. As shown in FIG. 2, the main body frame 68 of the printer head 63 is formed to be substantially a box shape having a bottom wall 68*a*, a front wall 68*b* and a back wall 68*c*, and an open upper surface. A cartage mounting part is formed in the box-shaped portion of the main body frame 68, and the four-color ink cartridges 61 as an ink supply source can be detachably attached from the open side (above).

As shown in FIG. 2, four ink supply passages 4*a* to 4*d* are provided on the upper surface of the bottom wall 68*a* of the main body frame 68 and at positions close to the front wall 68*b*. The respective ink supply passages 4*a* to 4*d* can be connected to ink release parts (not shown) of the respective ink cartridges 61, and communicate with the lower side of the bottom wall 68*a*. Packings (not shown) made of rubber, which can be brought into close contact with the ink release parts of the respective ink cartridges 61, are disposed on the upper surface (cartridge mounting part) of the bottom wall 68*a* of the main body frame 68.

Figure 3:
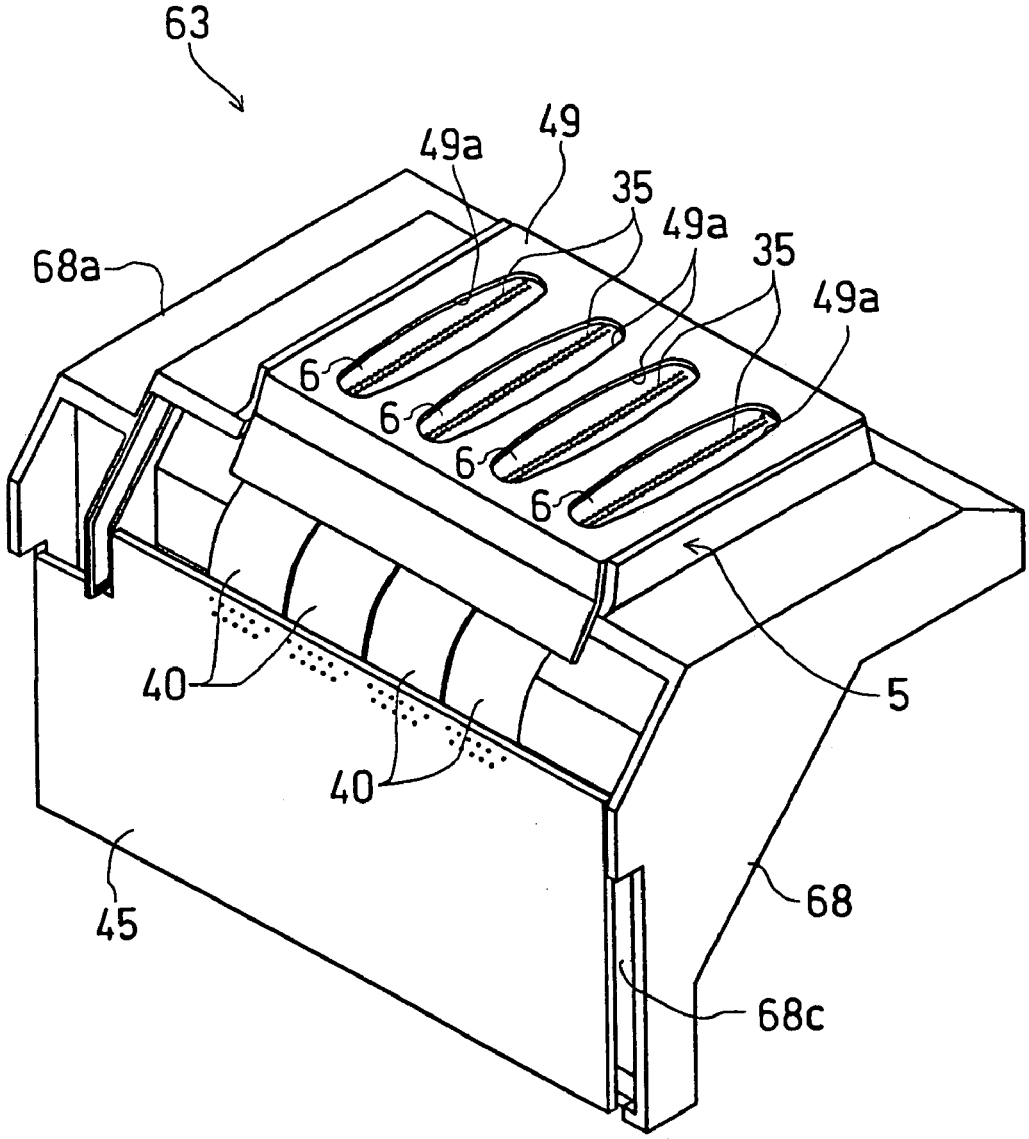
FIG. 3 is a perspective view showing a state where the printer head is upside down.
Figure 4:
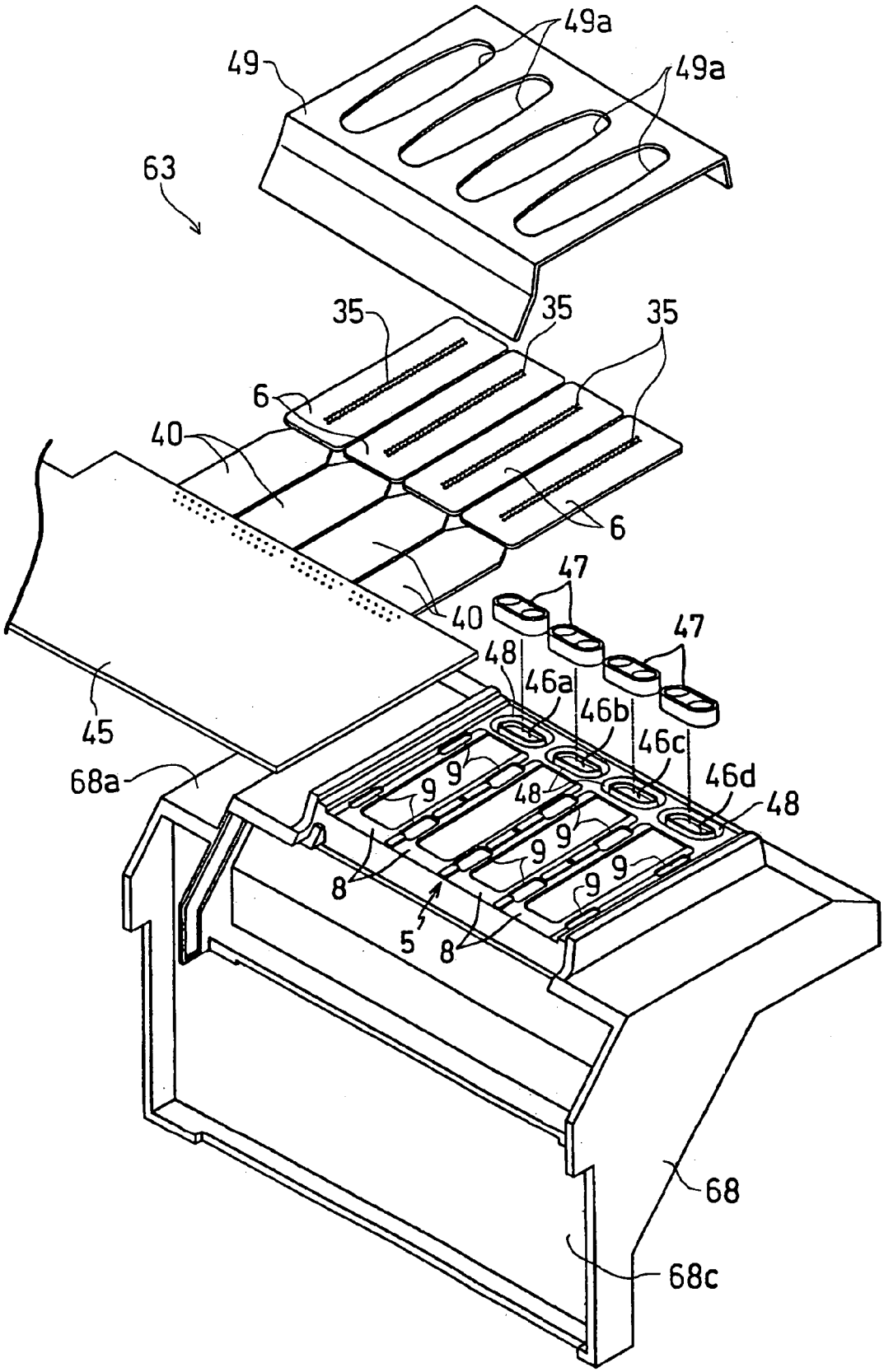
FIG. 4 is an exploded perspective view of the printer head.

As shown in FIGS. 3 and 4, a head holding part 5 is formed on the lower surface side of the bottom wall 68*a* of the main body frame 68. As shown in FIG. 4, in the head holding part 5, four support parts 8 are formed to be step-shaped, and the four ink-jet heads 6 corresponding to the respective ink cartridges 61 are fixed to the respective support parts 8. A plurality of spaces 9 are formed in each of the support parts 8 to vertically pass through. The spaces 9 are for fixing the ink-jet head 6 to the support part 8 by an ultraviolet ray curing adhesive.

Further, a head cover 49 is put to cover the four ink-jet heads 6 together with the head holding part 5. The head cover 49 includes openings 49*a*, and in the state where it is attached to the ink-jet heads 6, as shown in FIG. 3, a plurality of nozzles 35 of the respective ink-jet heads 6 are exposed through the openings 49*a*.

As shown in FIG. 3, a substantially rectangular circuit substrate 45 is disposed on the wall surface (wall surface at the side opposite to the carriage 64 in FIG. 1) of the back wall 68*c* of the main body frame 68, so that its plate surface becomes parallel to the back wall 68*c*. As shown in FIG. 4, the respective ink-jet heads 6 are connected to the circuit substrate 45 through flexible flat cables 40.

As shown in FIG. 4, communicating parts 46*a* to 46*d* communicating with the ink cartridges 61 through the ink supply passages 4*a* to 4*d* (FIG. 2) are provided at one ends of the respective support parts 8. Fitting grooves 48 are concavely provided around the outer peripheries of the respective communicating parts 46*a* to 46*d*. Packings 47 made of rubber or the like are respectively inserted in the fitting grooves 48. When the ink-jet heads 6 are bonded and fixed to the support parts 8, the tip ends of the packings 47 are pressed to the outer peripheries of openings of ink supply passages 39 of the ink jet heads 6 described later (see FIG. 5). By this, connection portions for connecting the communicating parts 46*a* to 46*d* and the ink supply passages 39 of the respective ink-jet heads 6 are sealed so that an ink leak does not occur.

[First Embodiment]

Figure 5:
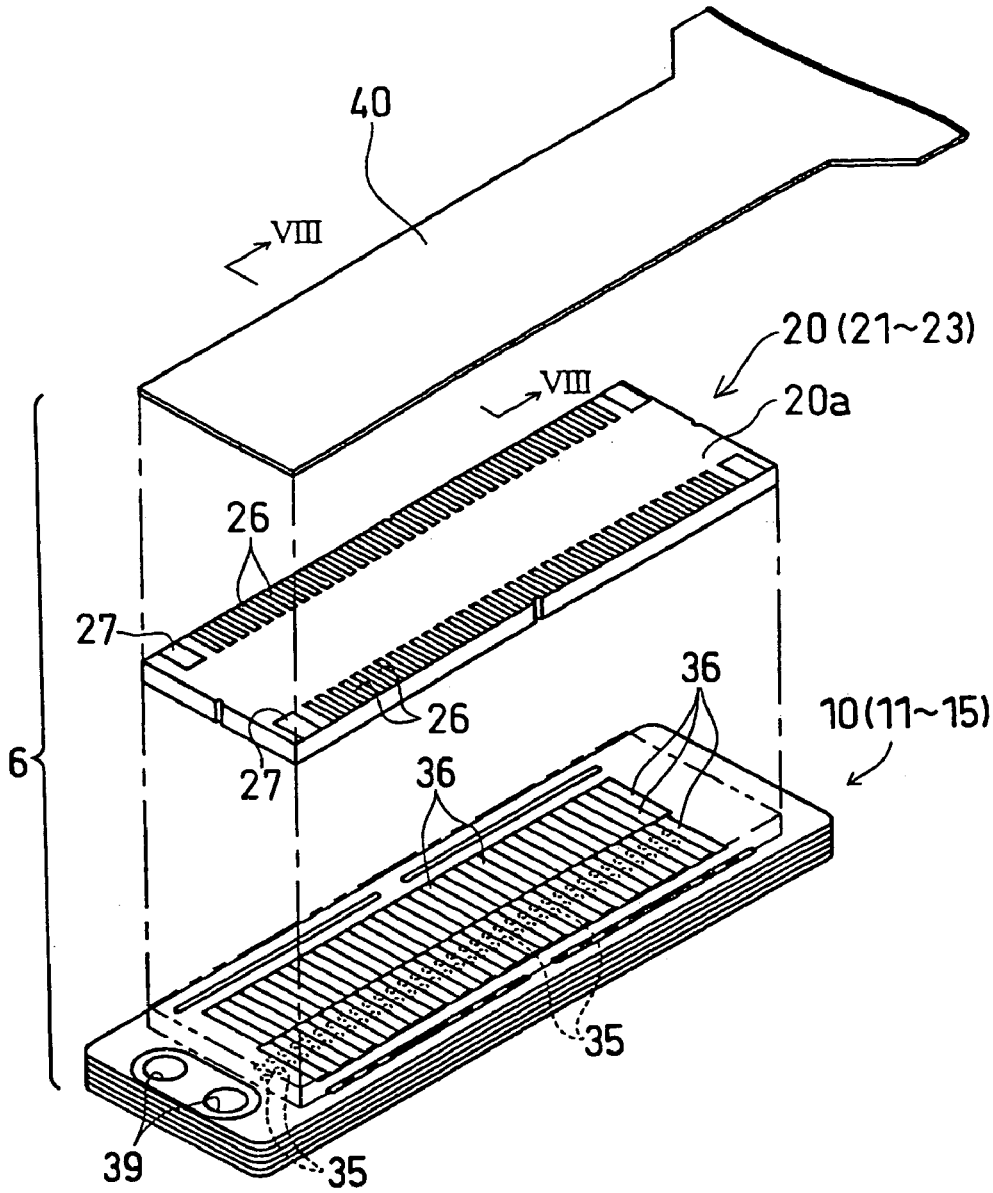
FIG. 5 is an exploded perspective view of an ink-jet head of a first embodiment.

FIG. 5 is a perspective view of an ink-jet head 6 according to a first embodiment. The ink-jet head 6 includes a rectangular passage unit 10 having a structure in which thin flat plates are laminated. A plate-type piezoelectric actuator (hereinafter referred to as an "actuator") 20 is bonded and laminated to the passage unit 10 through an adhesive or an adhesive sheet. Further, the flexible flat cable 40 for electrical connection to the circuit substrate 45 is overlapped with and is bonded to the upper surface of the actuator 20 through an adhesive. Many nozzles 35 are opened at the lower surface side (the side opposite to the platen roller 66) of the passage unit 10, and ink is ejected downward from the respective nozzles 35.

Figure 6:
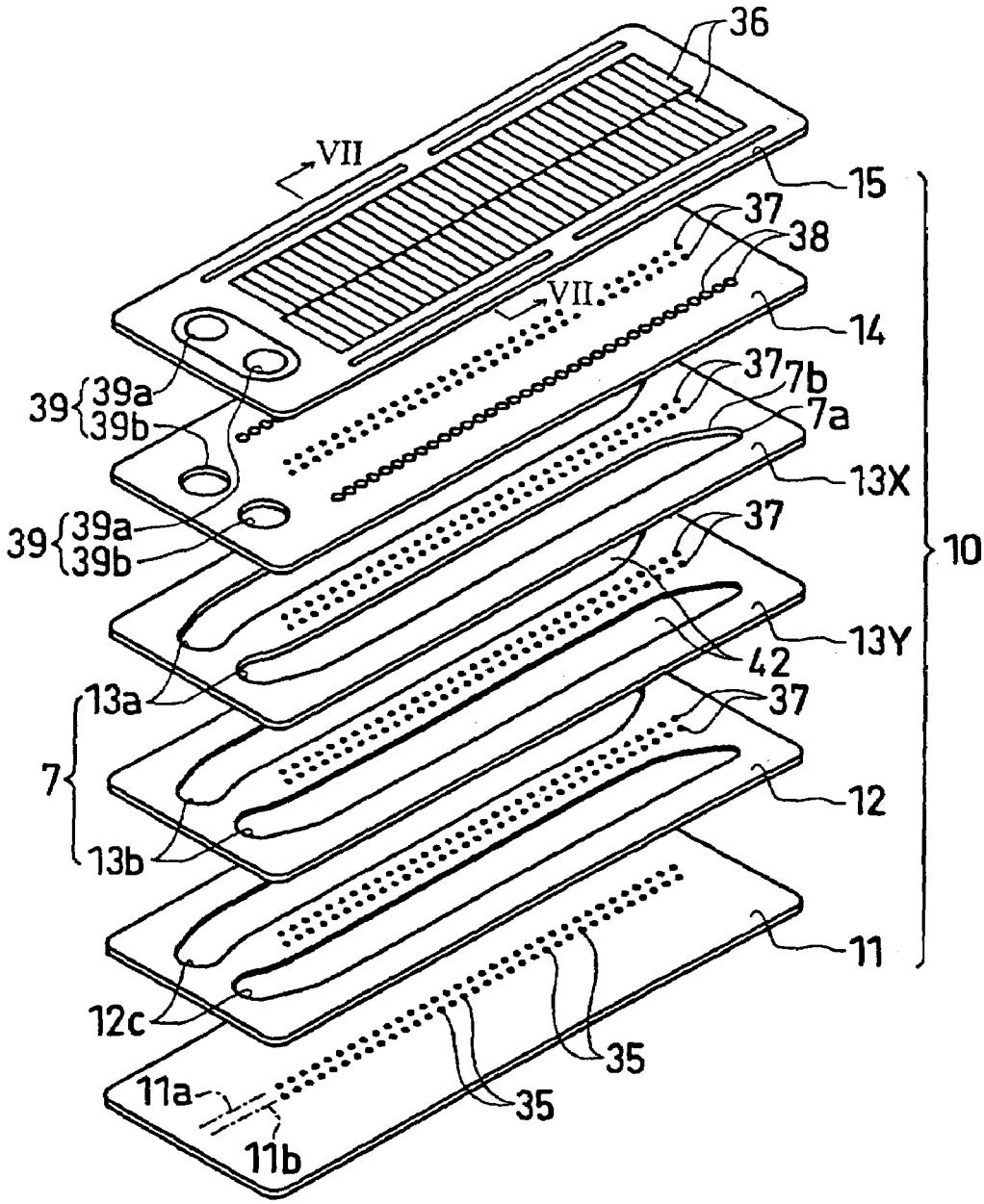
FIG. 6 is an exploded perspective view showing a laminate structure of a passage unit.
Figure 7:
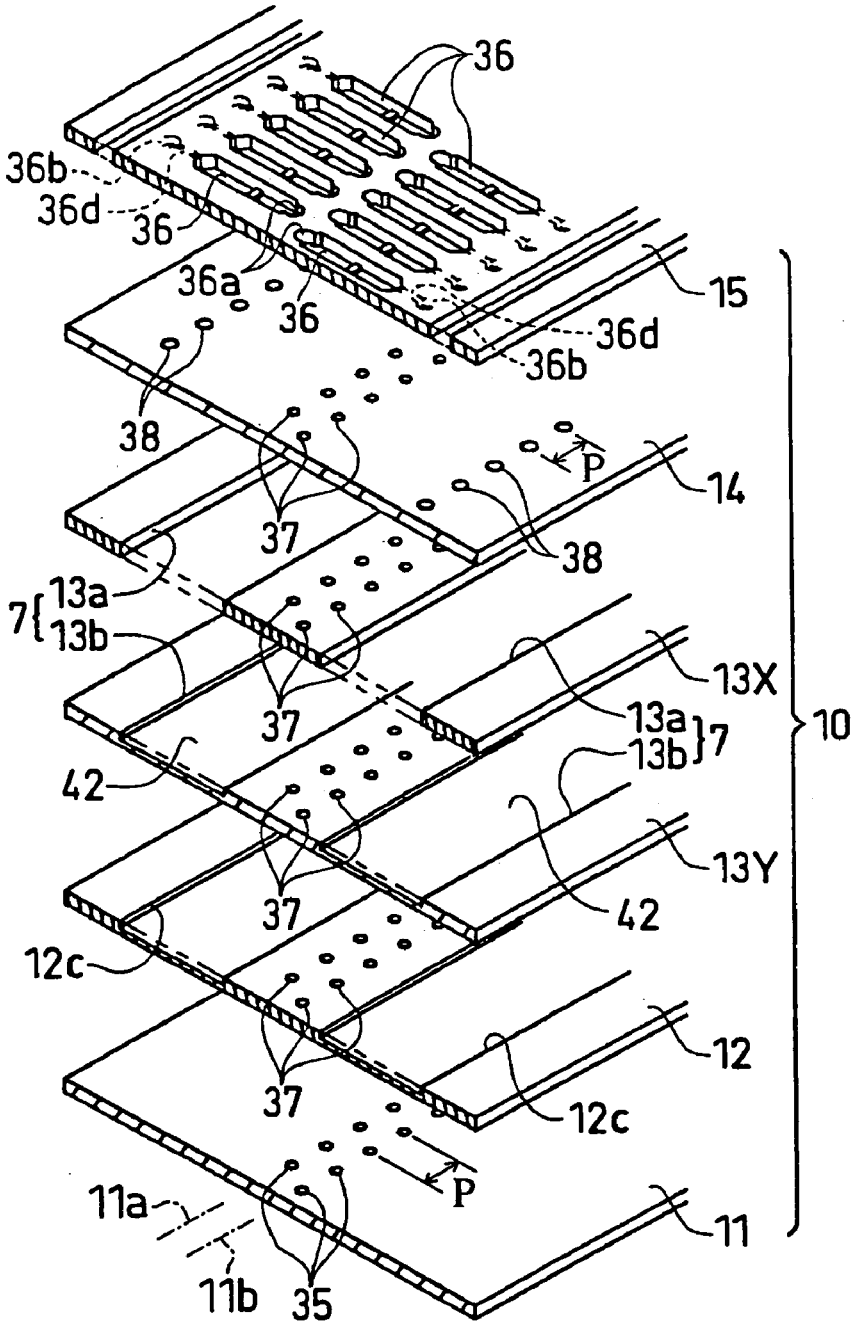
FIG. 7 is an exploded perspective view showing a VII—VII section of FIG. 6.

FIG. 6 is an exploded perspective view of the passage unit 10, and FIG. 7 is an exploded enlarged perspective view (section in a VII—VII direction of FIG. 6) of the passage unit 10. As shown in FIGS. 6 and 7, the passage unit 10 has a structure in which six thin metal plates in total, that is, a nozzle plate 11, a damper plate 12, two manifold plates 13X and 13Y, a spacer plate 14, and a base plate 15 are respectively overlapped and bonded through adhesives and are laminated, In this embodiment, these flat plates 11 to 15 are made of 42% nickel alloy. All of the flat plates 11 to 15 have slightly slender rectangles, and have thicknesses of about 50 μm to 150 μm.

As shown in FIGS. 6 and 7, the many ink ejecting nozzles 35 having minute diameters (in this embodiment, about 25 μm) are formed in the nozzle plate 11. The nozzles 35 are arranged in two staggered rows at minute intervals (pitch P shown in FIG. 7) along center lines 11*a* and 11*b* of the nozzle plate 11.

Figure 8:
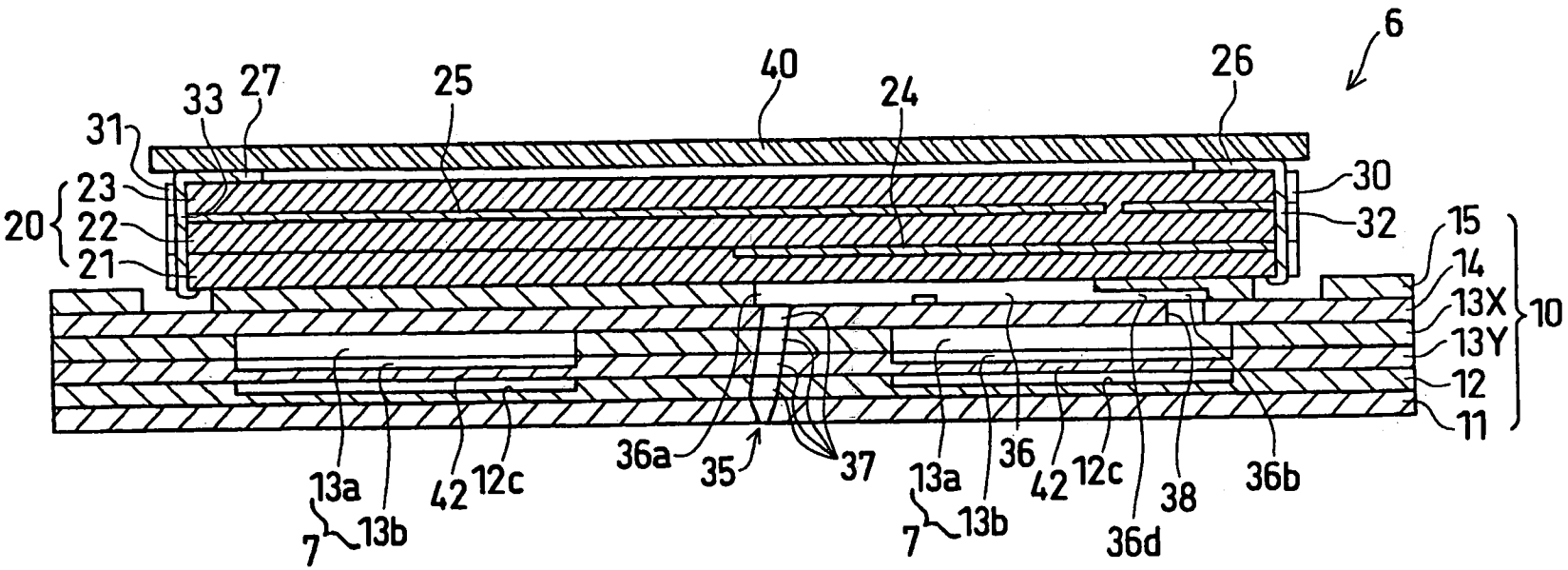
FIG. 8 is a view of a VIII—VIII section of FIG. 5.
Figure 9:
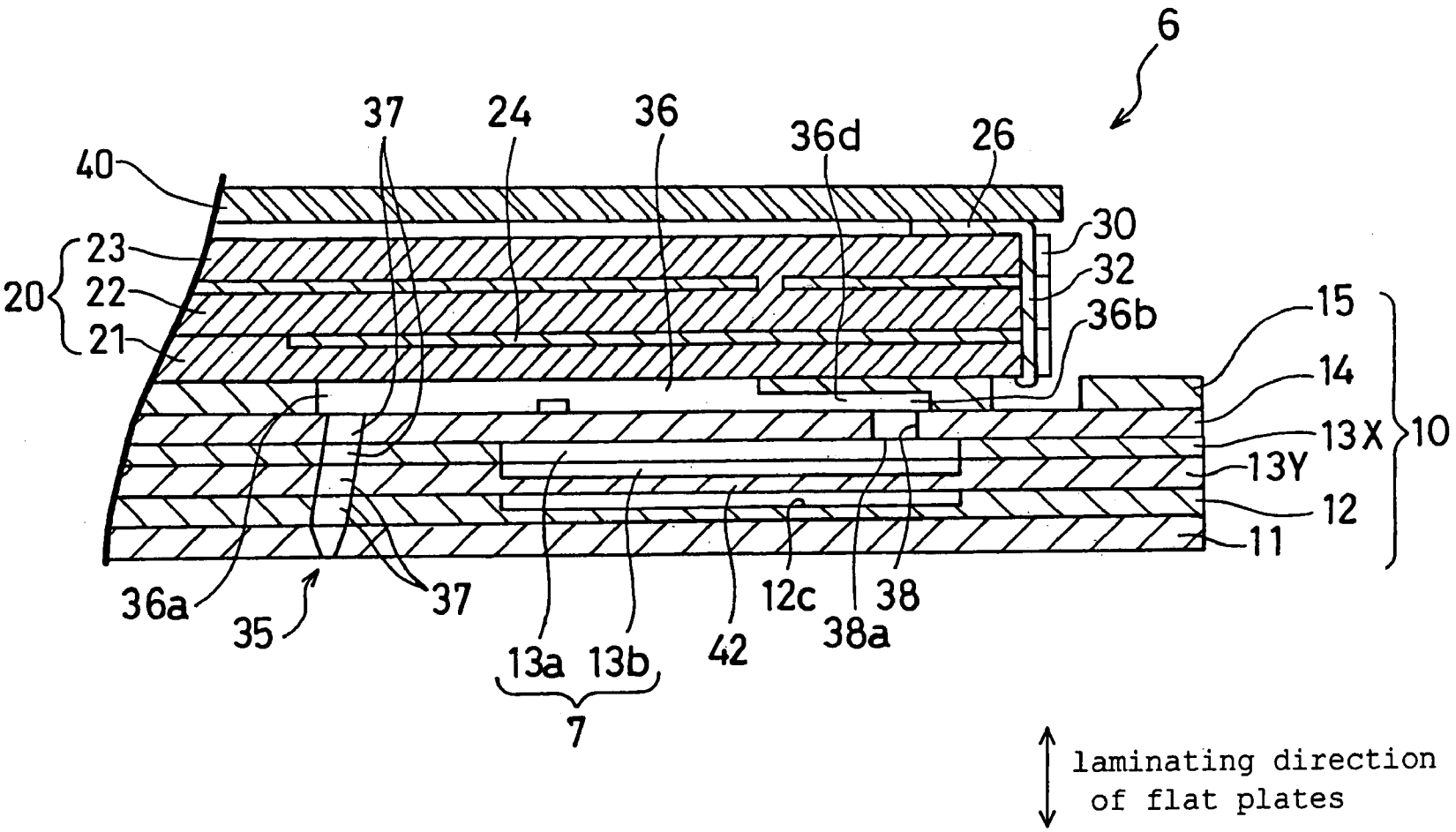
FIG. 9 is an enlarged sectional view showing the details of a passage structure in a passage unit.

As shown in FIG. 7, a plurality of pressure chambers 36, 36 are disposed in two rows in a staggered arrangement along the longitudinal direction of the base plate 15. Each of the pressure chambers 36 is formed to be slender so that its longitudinal direction is orthogonal to the longitudinal direction of the base plate 15. Besides, as shown in FIGS. 7 to 9, throttle parts 36*d* connected to the respective pressure chambers 36 and ink introduction holes 36*b* connected to the throttle parts 36*d* are concavely provided at the side of the base plate 15 facing the spacer plate 14.

The passage cross-sectional area (cross-sectional area in the direction orthogonal to the ink flow direction) of each of the throttle parts 36*d* is smaller than the passage cross-sectional area of each of the pressure chambers 36. This is for increasing the passage resistance by decreasing the cross-sectional area of the throttle part 36*d*. That is, a pressure wave generated in the pressure chamber 36 by the driving of an after-mentioned actuator 20 goes toward the nozzle 35, while its reflected wave goes toward the common ink chamber 7. This flow of ink returning from the pressure chamber 36 to the common ink chamber 7 is restricted by the throttle part 36*d*, so that the pressure wave from the pressure chamber 36 is efficiently made to go toward the nozzle 35, and the ejection speed of ink from the nozzle 35 is improved.

Ink supply holes 38 are bored in the areas of the spacer plate 14 at both sides in the lateral direction correspondingly to the ink introduction holes 36*b*. Besides, the after-mentioned common ink chambers 7 and 7 are formed in the manifold plates 13X and 13Y. As shown in FIG. 9 or the like, the respective ink introduction holes 36*b* of the base plate 15 communicate with the common ink chambers 7 through the ink supply holes 38.

Besides, as shown in FIGS. 6 and 7, minute diameter through holes 37 are bored in a staggered arrangement in the spacer plate 14, the two manifold plates 13X and 13Y, and the damper plate 12. As shown in FIG. 8 or the like, one ends 36*a* of the respective pressure chambers 36 communicate with the foregoing nozzles 35 in the nozzle plate 11 through the through holes 37.

As shown in FIG. 7, two ink chamber half parts 13*a* and 13*a* are formed to pass through the manifold plate 13X of the two manifold plates (13X, 13Y) closer to the spacer plate 14. On the other hand, in the manifold plate 13Y at the side of the nozzle plate 11, two ink chamber half parts 13*b* and 13*b* are concavely provided to open only toward the manifold plate 13X of the other side.

In this structure, three plates in total, that is, the two manifold plates 13X and 13Y and the spacer plate 14 are laminated, so that the corresponding upper and lower ink chamber halt parts 13*a* and 13*b* are mutually connected, and one at each of both sides of the row of the through holes 37, that is, the two common ink chambers 7 and 7 in total are formed as shown in FIGS. 8 and 9.

As shown in FIG. 6, the common ink chambers 7 and 7 are formed to be slender, and are provided at both sides of the row of the through holes 37 to be substantially parallel to the row. Besides, the common ink chambers 7 and 7 are positioned on a plane parallel to a plane formed of the plurality of pressure chambers 36 in the base plate 15, and are positioned closer to the nozzle plate 11 than the pressure chambers 36.

Incidentally, the reason why the two common ink chambers 7 and 7 are provided at both the sides of the row of the through holes 37 is that they are made to correspond to the pressure chambers 36 and the nozzles 35 disposed in the two rows. That is, the one common ink chamber 7 communicates with the nozzles 35 and the pressure chambers 36 of the one row in the pressure chambers 36 of the two rows through the ink supply holes 38 of the spacer plate 14, and similarly, the other common ink chamber 7 communicates with the nozzles 35 and the pressure chambers 36 of the other row through the ink supply holes 38.

By constructing the ink-jet head 6 as stated above, it becomes possible to use a print mode in which different color inks are supplied to the two common ink chambers 7 and 7 and printing of two colors is performed by the one ink-jet head 6, and the versatility of the ink-jet head 6 is raised to reduce the kinds of parts. However, in this embodiment, a print mode is adopted in which same color inks are supplied to both the common ink chambers 7 and 7, and single color high resolution printing is performed by the two rows of nozzles 35.

As shown in FIG. 7, damper grooves 12*c* and 12*c* are concavely provided in the damper plate 12 positioned immediately under the manifold plates 13X and 13Y. The damper grooves 12*c* and 12*c* are formed to be open only toward the side of the manifold plate 13Y, and the positions and shapes are made to coincident with those of the common ink chambers 7 and 7.

In this structure, when the manifold plates 13X and 13Y and the damper plate 12 are connected, the damper grooves 12*c* are concavely positioned at portions (damper parts 42) where the ink chamber half parts 13*b* of the manifold plate 13Y are provided. Here, since the manifold plate 13Y is made of a metal material (in this embodiment, 42% nickel alloy) which can be elastically deformed, the damper part 42 can be freely vibrated toward the side of the common ink chamber 7 and the side of the damper groove 12*c*.

From the above structure, even if the pressure variation occurring in the pressure chamber 36 at the time of ink ejection is propagated to the common ink chamber 7, the damper part 42 is elastically deformed to vibrate, so that the pressure variation can be absorbed and attenuated (damper function), and it is possible to prevent crosstalk in which the pressure variation is propagated to the other pressure chambers 36.

As shown in FIG. 6, two supply holes. 39*a* and 39*a* are bored in the base plate 15, and also in the spacer plate 14, supply holes 39*b* and 39*b* are similarly bored. The corresponding supply holes 39*a* and 39*b* are mutually connected by coupling the base plate 15 and the spacer plate 14, and ink supply passages 39 and 39 corresponding to the two common ink chambers 7 and 7 are formed.

From a demand for miniaturization of the ink-jet head 6, the ink supply passages 39 and 39 are bored at positions near the ends of the rows of the plurality of pressure chambers 36, 36 . . . , and the two ink supply passages 39 and 39 are disposed to be mutually close to each other. Not-shown filters are provided in the openings of the ink supply passages 39 and protect so that even if a foreign substance or the like is mixed in the ink at the time of attachment/detachment of the ink cartridge 61 to/from the cartridge mount part, the foreign substance or the like does not enter the common ink chambers 7.

By the above structure of the passage unit 10, the ink flowing in the common ink chambers 7 and 7 from the ink supply passages 39 and 39 goes via the ink supply holes 38 and the ink introduction holes 36*b*, passes through the throttle parts 36*d* and is distributed to the respective pressure chambers 36. Then, the ink in the respective pressure chambers 36 goes from the one ends 36*a* via the respective through holes 37, 37 . . . to the corresponding nozzles 35 and is ejected.

In this embodiment, the total passage including the ink supply hole 38, the ink introduction hole 36*b*, and the throttle part 36*d* corresponds to the connection passage of the invention. This connection passage is provided for each of the nozzles 35 (each of the pressure chambers 36), its one end is connected to the common ink chamber 7, and the other end is connected to the pressure chamber 36.

Figure 10:
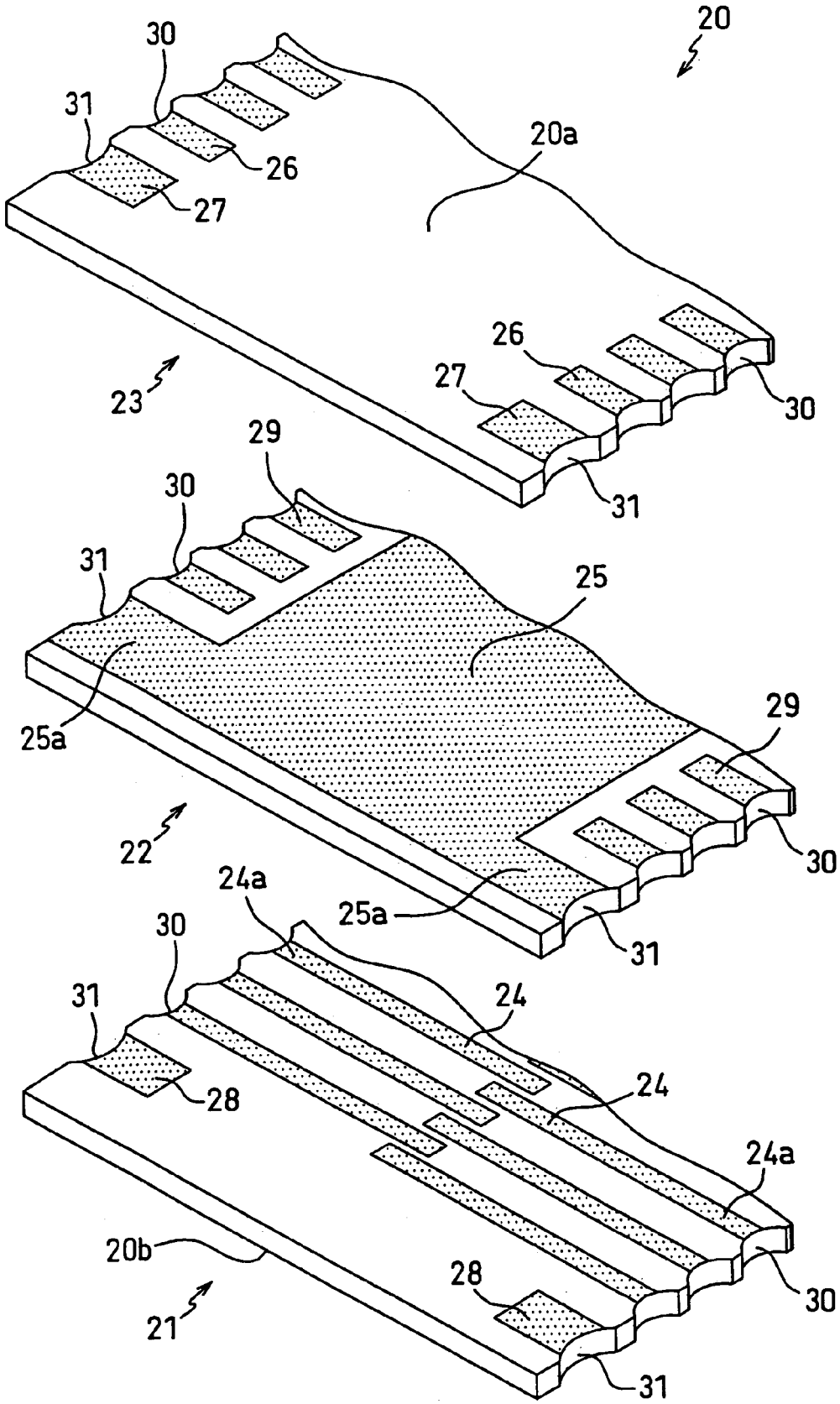
FIG. 10 is an exploded perspective view showing a laminate structure of an actuator.
Figure 11:
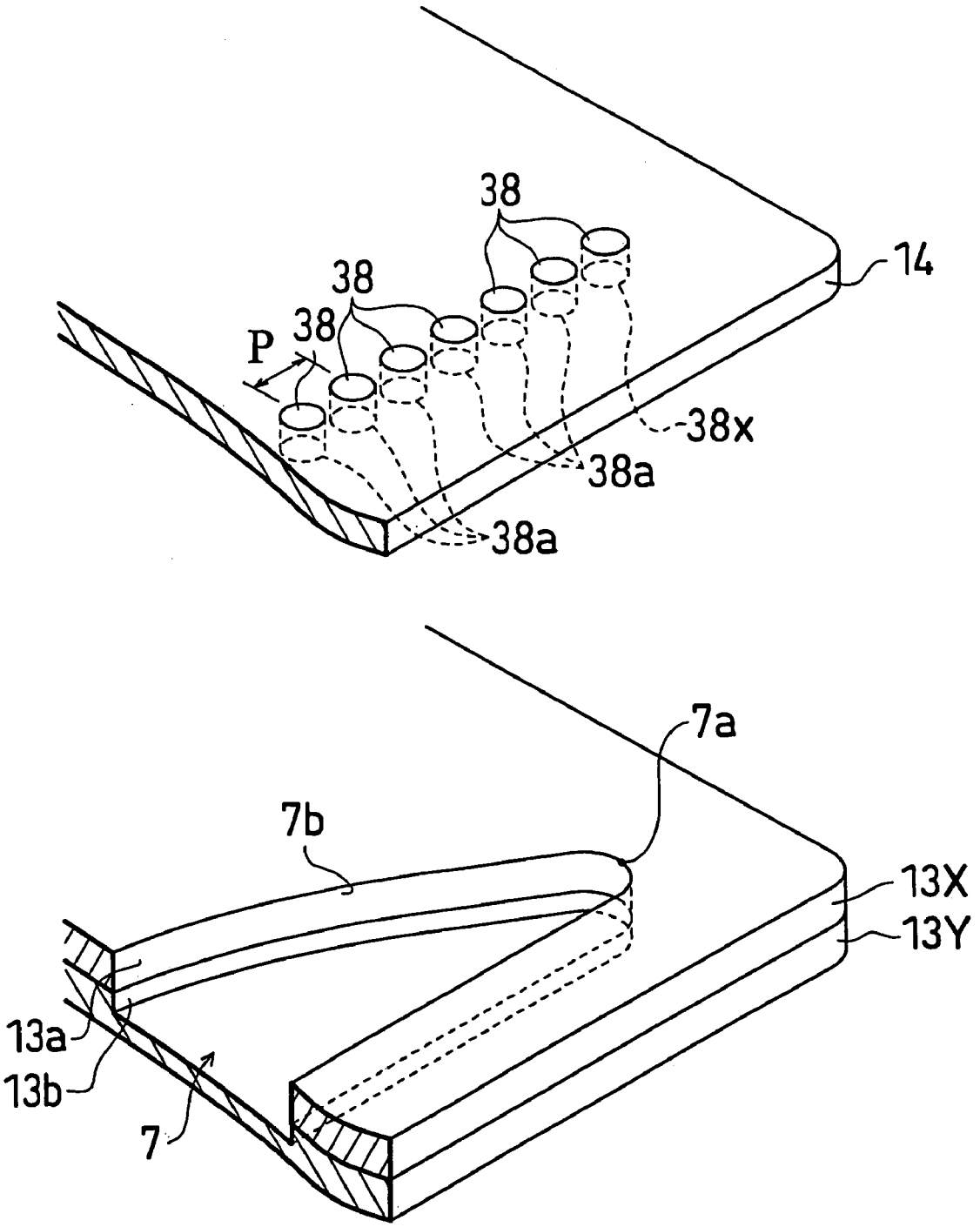
FIG. 11 is an exploded perspective view showing a detailed structure of a downstream side portion of a common ink chamber and ink supply holes in the passage unit.

FIG. 10 is an exploded enlarged view of an actuator 20. As shown in FIGS. 8 to 10, the actuator 20 has a structure in which two kinds of piezoelectric sheets 21 and 22 and one insulating sheet 23 are laminated. In this embodiment, the piezoelectric sheets 21 and 22 are made of ceramic material of lead zirconate titanate (PZT) having ferroelectricity.

As shown in FIG. 10, a plurality of thin driving electrodes 24 corresponding to the respective pressure chambers 36 in the passage unit 10 are provided in a staggered arrangement on the upper surface of the one piezoelectric sheet 21. One ends 24*a* of the respective driving electrodes 24 are formed to be exposed at both side surfaces orthogonal to front and back surfaces 20*a* and 20*b* of the actuator 20.

A common electrode 25 common to the plurality of pressure chambers 36 is provided on the upper surface of the other piezoelectric sheet 22. Similarly to the one ends 24*a* of the respective driving electrodes 24, one ends 25*a* of the common electrode 25 are also formed to be exposed at both sides. The piezoelectric sheets 21 and 22 are not limited to the structure in which they are alternately laminated one by one as shown in the drawing, and a plurality of sheets may be alternately laminated. Respective regions of the piezoelectric sheets 21 and 22 sandwiched between the respective driving electrodes 24 and the common electrode 25 become pressure generating parts corresponding to the respective pressure chambers 36.

Surface electrodes 26 corresponding to the respective driving electrodes 24 and surface electrodes 27 corresponding to the common electrode 25 are provided side by side along both sides on the upper surface of the uppermost insulating sheet 23.

Besides, at both sides, first recessed grooves 30 are provided at the one ends 24*a* of the respective driving electrodes 24 to extend in the laminate direction, and second recessed grooves 31 are provided at the one ends 25*a* of the common electrode 25 to extend in the laminate direction. As shown in FIG. 8, side electrodes 32 for electrically connecting the respective driving electrodes 24 and the respective surface electrodes 26 are formed in the respective first recessed grooves 30, and side electrodes 33 for electrically connecting the common electrode 25 and the surface electrodes 27 are formed in the second recessed grooves 31. Incidentally, electrodes 28 and 29 of FIG. 10 are waste pattern electrodes.

While the passage unit 10 and the actuator 20 having the above structures are aligned to make the respective pressure chambers 36 in the passage unit 10 correspond to the driving electrodes 24 in the actuator 20, they are laminated as shown in FIG. 5. Besides, on the upper surface 20*a* in the actuator 20, various wiring patterns (not shown) in the flexible flat cables 40 are electrically connected to the respective surface electrodes 26 and 27.

Then, when a voltage is applied between an arbitrary driving electrode 24 selected from the plurality of driving electrodes 24 of the actuator 20 and the common electrode 25 in the ink-jet head 6, a strain in the lamination direction by piezoelectricity occurs in the piezoelectric sheet 22 at the portion of the driving electrode 24 to which the voltage is applied (that is, the pressure generation part), and the volume of the pressure chamber 36 is reduced. In this way, ejection energy is given to the ink in the pressure chamber 36, the ink is ejected in the shape of a droplet from the nozzle 35, and predetermined printing is performed on the sheet of paper 62. By driving the carriage 64 (FIG. 1), while the printer head 63 is reciprocated in the main scanning direction and the sheet of paper 62 is intermittently sent in the sub scanning direction, the ink is ejected from the ink-jet head 6 as described above, so that a desired image is formed on the sheet of paper 62.

In the ink-jet head 6 of this embodiment as described above, the ink flows in the common ink chambers 7 and 7 from the ink supply passages 39 and 39, goes via the ink supply holes 38 and the ink introduction holes 36*b*, passes through the throttle parts 36*d* and is distributed to the respective pressure chambers 36. Then, the ink in the respective pressure chambers 36 is given the ejection pressure by the driving of the actuator 20, and goes from the one ends 36*a* via the respective through holes 37, 37, . . . to the corresponding nozzles 35 and is ejected.

As shown in FIGS. 6 and 7, the spacer plate (second member) 14 is laminated to be adjacent (that is, without intervention of another flat plate) to the manifold plates (first member) 13X and 13Y. The plurality of ink supply holes 38 of the spacer plate 14 are provided and are aligned to be parallel to the row of the through holes 37. As shown in FIGS. 9, 11, 12 and 13B, in the respective ink supply holes 38, openings 38*a* are formed in the surface of the spacer plate 14 at the side of the manifold plates 13X and 13Y.

The openings 38*a* correspond to the openings, at the side of the common ink chamber 7, of the connection passages for connecting the common ink chamber 7 and the pressure chambers 36. As shown in FIGS. 6 and 7, the ink supply holes 38 are arranged to correspond to the respective nozzles 35 through the pressure chambers 36, and the arrangement pitch thereof (arrangement pitch of the openings 38*a*) is made equal to the arrangement pitch P of the nozzles 35 (see FIG. 7).

Figure 12:
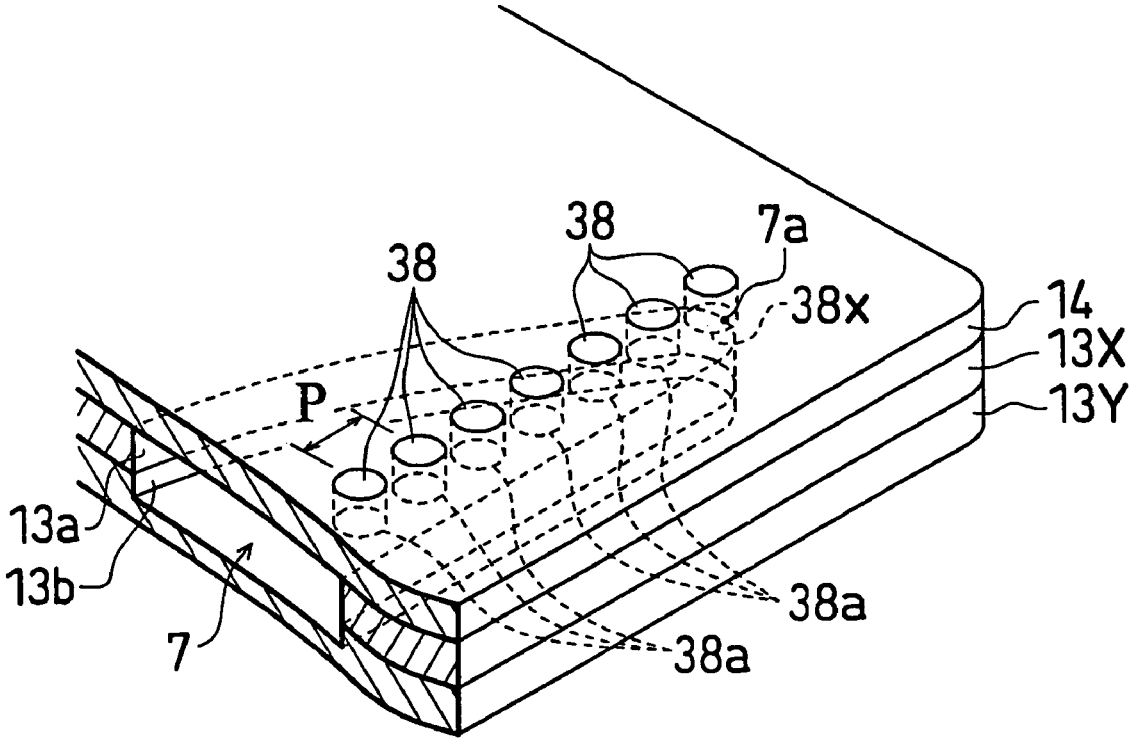
FIG. 12 is a partial perspective view showing the detailed structure of the downstream side portion of the common ink chamber and the ink supply holes in the passage unit.
Figure 13:
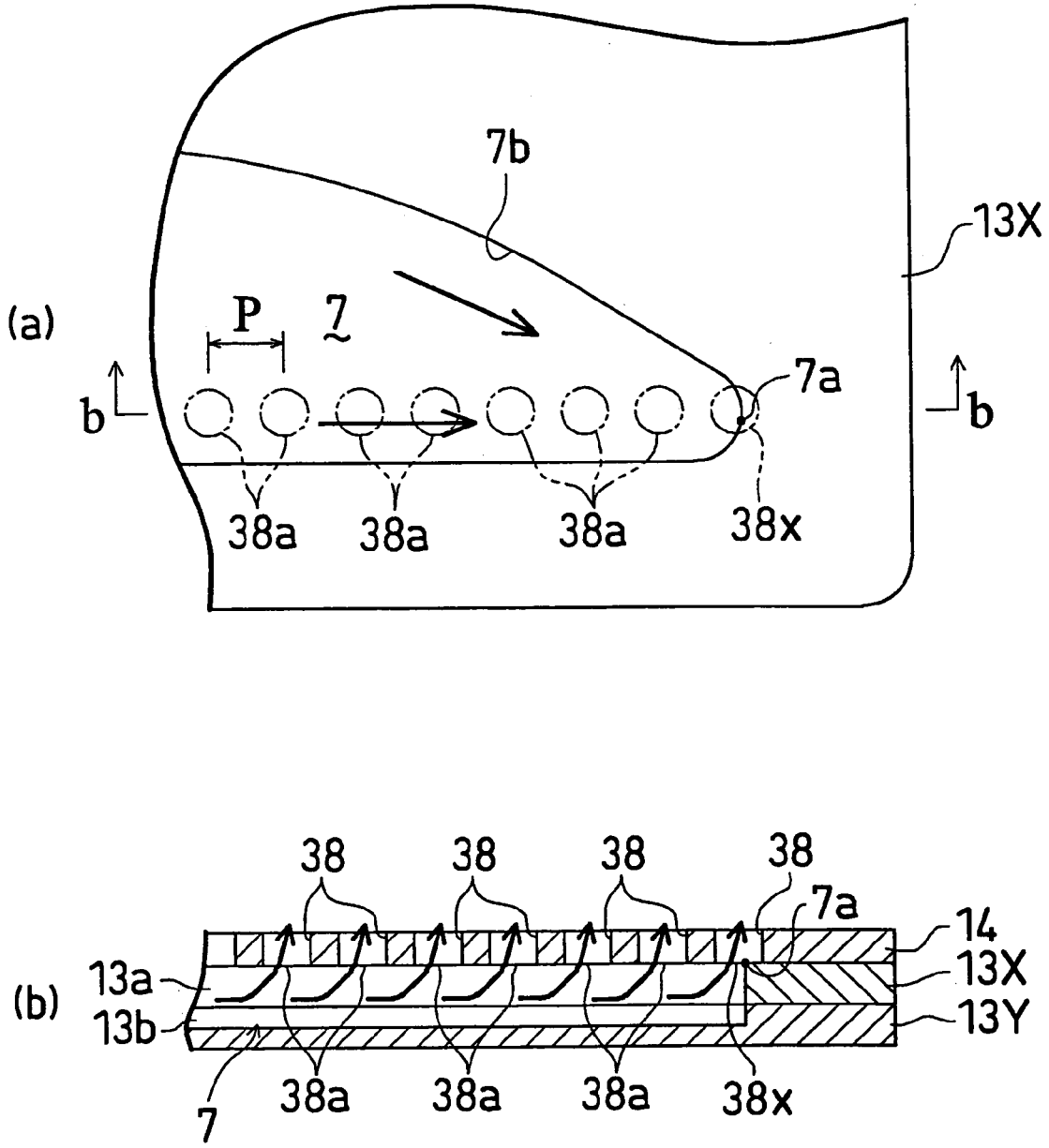
FIG. 13A is a plan view showing a relation between the common ink chamber and openings of the ink supply holes in the passage unit.
FIG. 13B is a sectional view taken along line b—b of FIG. 13A.

As shown in FIGS. 12 and 13A, the plurality of openings 38*a* are arranged substantially along the longitudinal direction of the common ink chamber 7. In other words, the common ink chamber 7 is extended in the alignment direction of the openings 38*a*. The ink supplied from the ink cartridge 61 to the common ink chamber 7 branches out and is introduced into the ink supply holes 38 through the openings 30*a* as indicated by thick arrows of FIG. 13, and flows substantially along the alignment direction of the openings 38*a* from one end side (side of the ink supply passage 39) of the common ink chamber 7 to the other end side.

Incidentally, in the drawings, among the plurality of openings 38*a*, an opening positioned at the most downstream end (one end in the alignment direction of the openings 38*a*) in the flowing direction of the ink from the ink supply passage 39 in the common ink chamber 7 is particularly denoted by a symbol 38*x*.

Then, in this embodiment, as shown in FIGS. 12, 13A and 13B, a most downstream side end 7*a* of a wall part of the manifold plates 13X and 13Y forming the common ink chamber 7 is positioned at a portion of the opening 38*x* positioned at the most downstream side of the ink flow in the common ink chamber 7. That is, as shown in FIG. 13A or the like, a projection of the opening 38*x*, which is positioned at the most downstream end, on the manifold plates 13X and 13Y in the plate thickness direction (a projection in the direction of connecting the spacer plate 14 and the manifold plates 13X and 13Y) straddles the contour of the common ink chamber 7 of the manifold plates 13X and 13Y at the most downstream end.

Here, when the ink cartridges 61 are exchanged, in order to introduce the ink from the new ink cartridges 61 to the ink-jet heads 6, the suction operation by the purge mechanism 67 is performed. At this time, when the ink cartridges 61 are connected to the ink supply passages 4*a* to 4*d* (FIG. 2), air having entered the connection portions is mixed in the ink, passes through not-shown filters of the ink supply passages 39 and 39 to become minute air bubbles, and enters the common ink chambers 7 and 7. Most of the air bubbles are discharged from the nozzles 35 via the pressure chambers 36 from the ink supply holes 38 by the suction operation of the purge mechanism 67. However, even by the purge operation of the purge mechanism 67, it is difficult to completely discharge the air bubbles.

Besides, also in a normal use state, with the lapse of time, it is inevitable that air having entered from the ink cartridge 61 or the wall surface of the supply passage grows into air bubbles, and together with the air bubbles remaining at the time of introduction, they are carried on the flow of the ink (the flow at the time of the purge operation and printing operation), and are apt to collect in the vicinity of the end 7*a* of the common ink chamber 7 at the most downstream side.

However, in this embodiment, as shown in FIGS. 12, 13A and 13B, the projection of the opening 38*x*, which is positioned at the most downstream end, on the manifold plates 13X and 13Y in the connecting direction straddles the contour of the common ink chamber 7 of the manifold plates 13X and 13Y at the most downstream end. In other words, the opening 38*x* positioned at one end in the alignment direction is partially closed by the area of the manifold plates 13X and 13Y forming the end 7*a* of the common ink chamber 7 in the longitudinal direction. Further, in other words, in the opening 38*x* positioned at the most downstream side, only its part at one side in the alignment direction faces the most downstream side of the common ink chamber 7.

By this, even in the case where the ink supplied into the common ink chamber 7 reaches the end 7*a* of the common ink chamber 7 at the most downstream side, it does not stagnate at the end 7*a* and is introduced from the opening 38*x* into the ink supply hole 38 (see a thick arrow of FIG. 13B). Accordingly, even if air bubbles are mixed into the common ink chamber 7 and are moved to the vicinity of the end of the common ink chamber 7 (the end 7*a* at the downstream side), the air bubbles are apt to be smoothly discharged through the opening 38*x* positioned at the most downstream side. Accordingly, since the discharge property of air bubbles is improved in the purge operation, it is possible to avoid a blank of a print surface (missing dot) due to non-ejection of ink from the nozzle 35 at the time of printing operation, Incidentally, in this embodiment, although the description has been given of the ink-jet head 6 in which the manifold plates (first member) 13X and 13Y and the spacer plate (second member) 14 have the thin flat plate shapes, the first member and the second member are not limited to the flat plate shapes.

Figure 14:
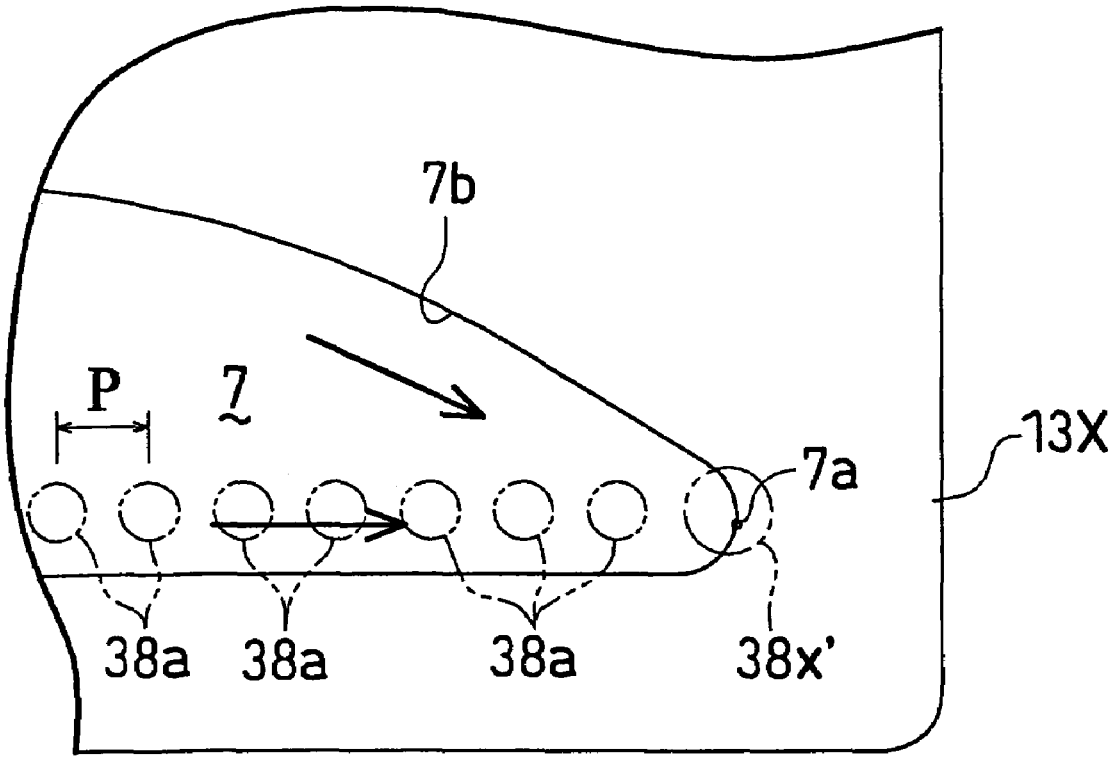
FIG. 14 is a plan view of another example in which an opening area of an opening at the most downstream side is enlarged.

Besides, in the embodiment, although all of the openings 38*a*, 38*a*, . . . of the ink supply holes 38 at the side of the common ink chamber 7 have the same size, the invention is not limited to this. That is, as shown in FIG. 14, an opening 38*x*' of the openings 38*a*, 38*a*, . . . at the most downstream side may have the largest opening area among the openings 38*a*, 38*a*, . . . .

By this, even if a bonding shift slightly occurs at the time when the manifold plates 13X and 13Y and the spacer plate 14 are laminated, the end 7*a* of the wall part of the common ink chamber 7 at the most downstream side becomes hard to deviate from the opening 38*x*' at the most downstream side. That is, even if a position shift slightly occurs between the upper manifold plate 13X and the spacer plate 14, the merit of the invention can be certainly exhibited in which the ink flow to the opening 38*x*' at the most downstream side is ensured and the discharge property of air bubbles in the vicinity of the wall part of the end 7*a* of the common ink chamber 7 at the most downstream side is improved.

Figure 15:
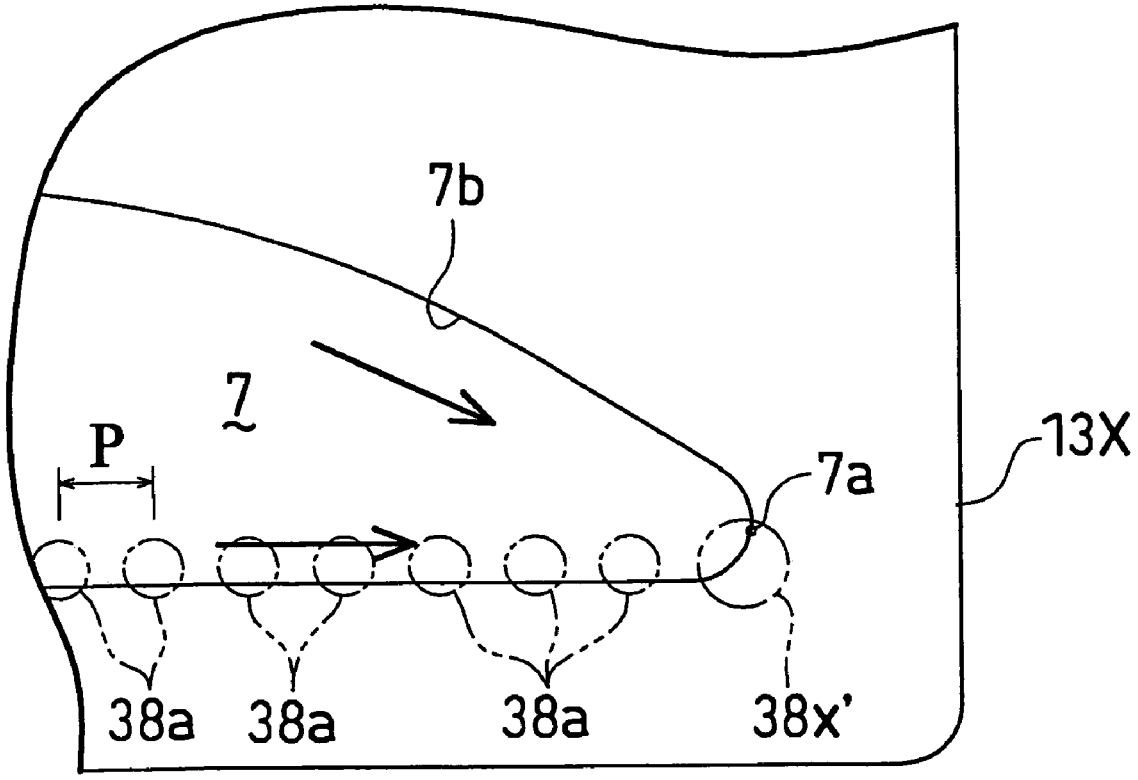
FIG. 15 is a plan view of another example in which all openings are disposed to overlap with a wall part of a common ink charter.

Besides, as shown in FIG. 15, all the openings 38*a*, 38*a*, . . . may be disposed to partially overlap with the wall part of the common ink chamber 7. That is, all the openings 38*a*, 38*a*, . . . may be structured to be partially closed by an area of the manifold plates 13X and 13Y forming the wall part of the common ink chamber 7. In other words, only part of each of all the openings 38*a*, 38*a*, . . . may face the common ink chamber 7.

By this, stagnation becomes hard to generate at not only the end 7*a* at the most downstream side of the ink flow in the common ink chamber 7, but also the vicinity of the wall part of a portion other than the most downstream side. As a result, the discharge property of air bubbles at the portion other than the portion of the common ink chamber 7 at the most downstream side is also improved, non-ejection due to air bubbles does not occur, and the highly reliable ink-jet head can be provided.

Figure 16:
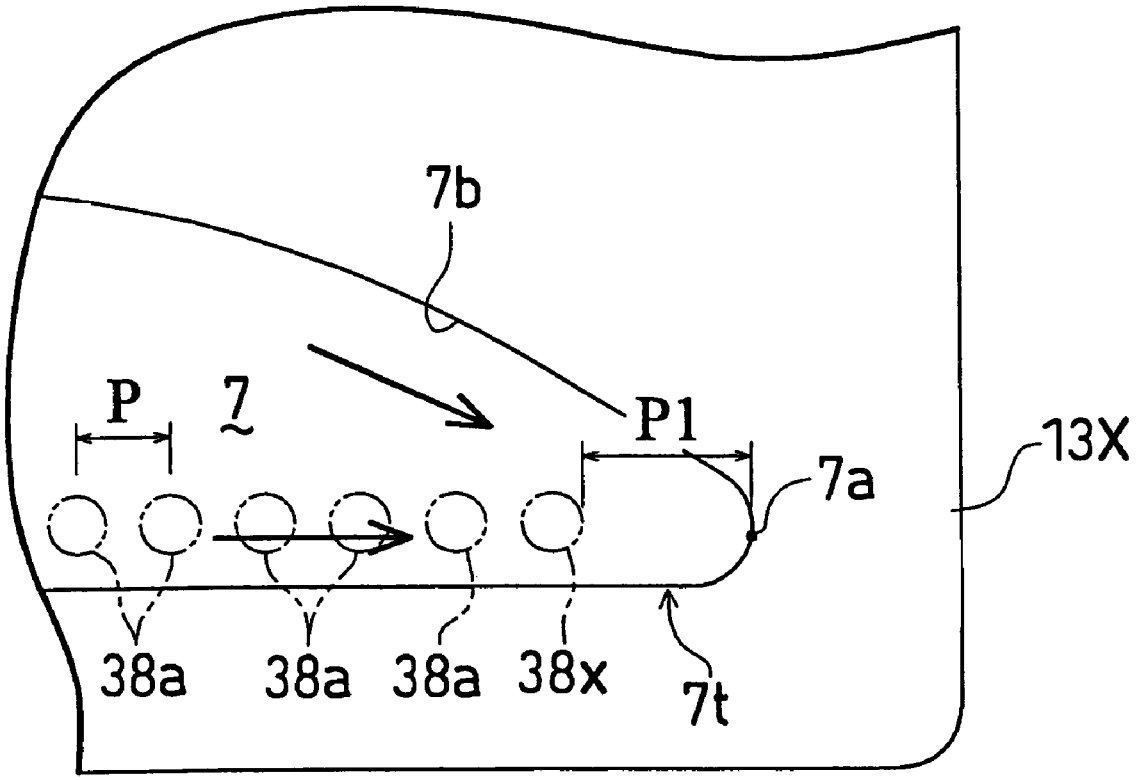
FIG. 16 is a plan view of another example in which an opening at the most downstream side is disposed to be spaced apart from the end of the common ink chamber at the most downstream side.

Further, as shown in FIG. 16, a plane distance P1 between the opening 38*x* positioned at the most downstream side of the ink flow in the common ink chamber 7 and the end 7*a* of the common ink chamber 7 at the most downstream side may be made at least an arrangement pitch P of the openings 38*a* (P1≧P). In this case, in the common ink chamber 7, the end 7*a* at the most downstream side of the ink flow from the ink supply passage 39 forms an ink trap part 7*t* for collecting the ink, and the length of the ink trap part 7*t* in the alignment direction of the openings 38*a* is the plane distance P1.

In this case, although air bubbles mixed in the common ink chamber 7 are apt to accumulate at the end 7*a* (the ink trap part 7*t*) of the common ink chamber 7 at the most downstream side, since the plane distance P1 between the opening 38*x* at the most downstream side and the end 7*a* of the common ink chamber 7 at the most downstream side is not less than the arrangement pitch P of the ink supply holes 38 (not less than the arrangement pitch P of the openings 36*a*) and is sufficiently large (P1≧P), the volume of the ink trap part 7*t* can be sufficiently ensured. That is, there does not occur such a state that the air bubbles accumulated at the end 7*a* at the most downstream side exceed the volume of the ink trap part 7*t* in a short time and close the opening 38*x* at the most downstream side.

That is, it takes a considerable time before an amount of the air bubbles in the vicinity of the end 7*a* of the common ink chamber 7 at the most downstream side becomes large, and the air bubbles are combined and grow there to reach the position of the opening 38*x* at the most downstream side. As a result, even if the frequency of the purge operations by the purge mechanism 67 is made low (even if the interval of the purge operations is made long), the opening 38*x* at the most downstream side comes to be scarcely closed by the air bubbles.

In the ink trap part 7*t*, since a cluster of air bubbles accumulated and combined to grow into a considerable size is sufficiently large, the surface tension of the air bubble cluster to keep the stability as a spherical shape is low. Accordingly, in the case where the purge operation by the purge mechanism 67 is performed, the air bubble cluster can not resist the suction force of ink from the opening 38*x* and the stability of its interface is broken, so that the air bubble cluster becomes apt to be easily discharged from the opening 38*x* through the ink supply hole 38.

In the case of FIG. 16, the plane distance P1 between the opening 38*x* positioned at the most downstream side of the ink flow in the common ink chamber 7 and the end 7*a* of the common ink chamber 7 at the most downstream side has only to be at least the arrangement pitch P of the ink supply holes 38. That is, it may be 2 pitches, 3 pitches, 4 pitches or 5 pitches, or may be 1.3 pitches, 1.5 pitches or the like.

In the examples of FIGS. 13 to 16, the common ink chamber 7 has a tapered part 7*b* at the downstream side. In the tapered part 7*b*, the cross-sectional area of the common ink chamber 7 is reduced toward the end 7*a* at the most downstream side. Accordingly, both at the time of printing operation and at the time of purge operation by the purge mechanism 67, the flow rate of the ink flow in the common ink chamber 7 at the downstream side end (the portion of the tapered part 7*b*) is increased toward the end 7*a* at the most downstream side. As a result, it becomes easy to forcibly push out the air bubbles to the opening 38*x* (38*x*') at the most downstream side, and also in this meaning, the discharge property of air bubbles in the common ink chamber 7 is improved,

[Second Embodiment]

Figure 17:
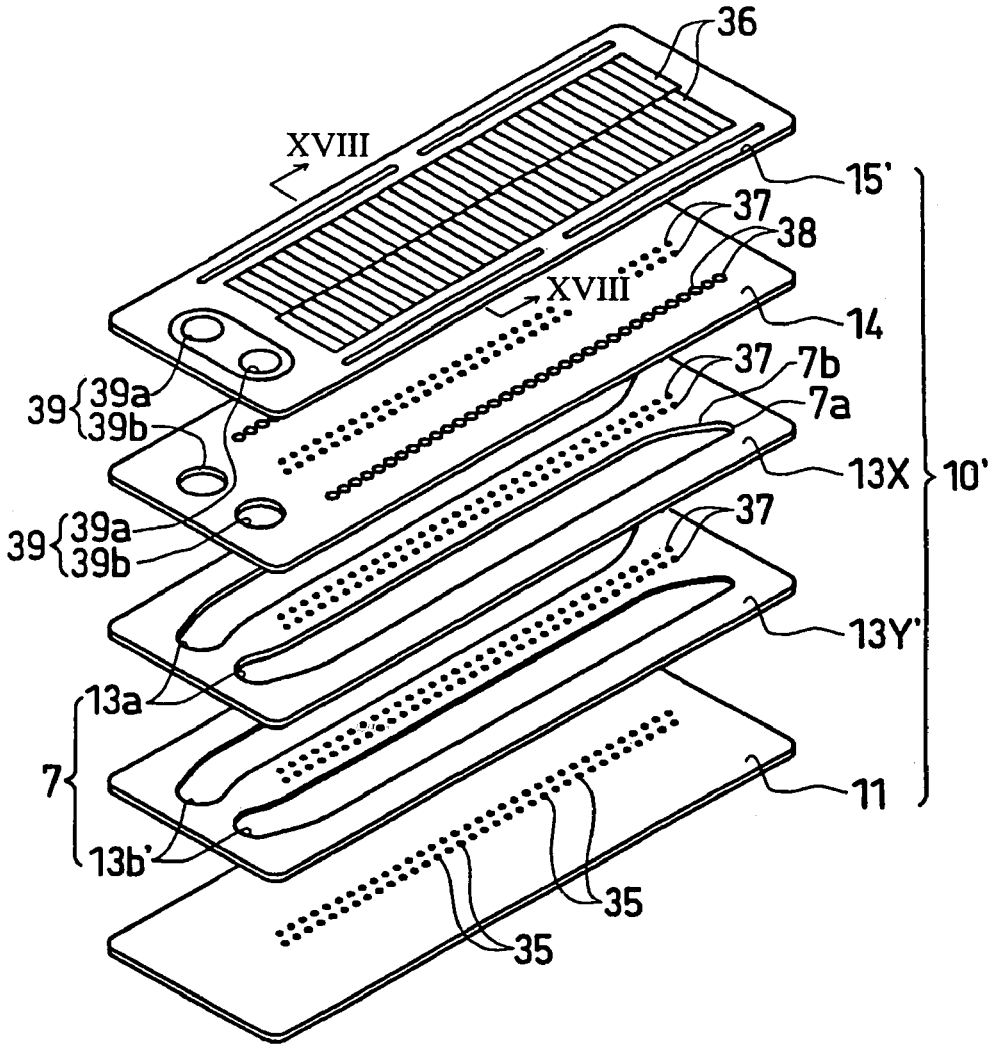
FIG. 17 is an exploded perspective view showing a laminate structure of a passage unit in an ink-jet head of a second embodiment.
Figure 18:
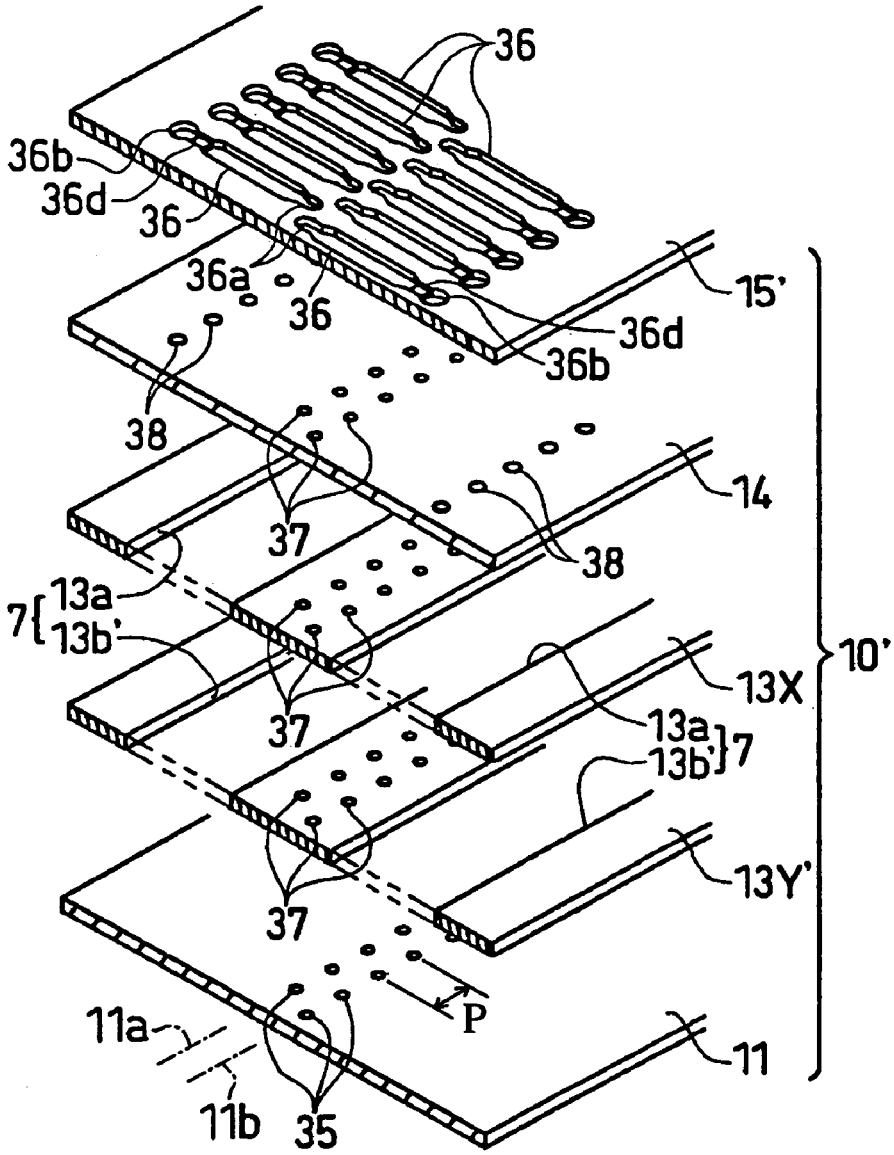
FIG. 18 is an exploded perspective view showing a section taken along line XVIII—XVIII of FIG. 17.
Figure 19:
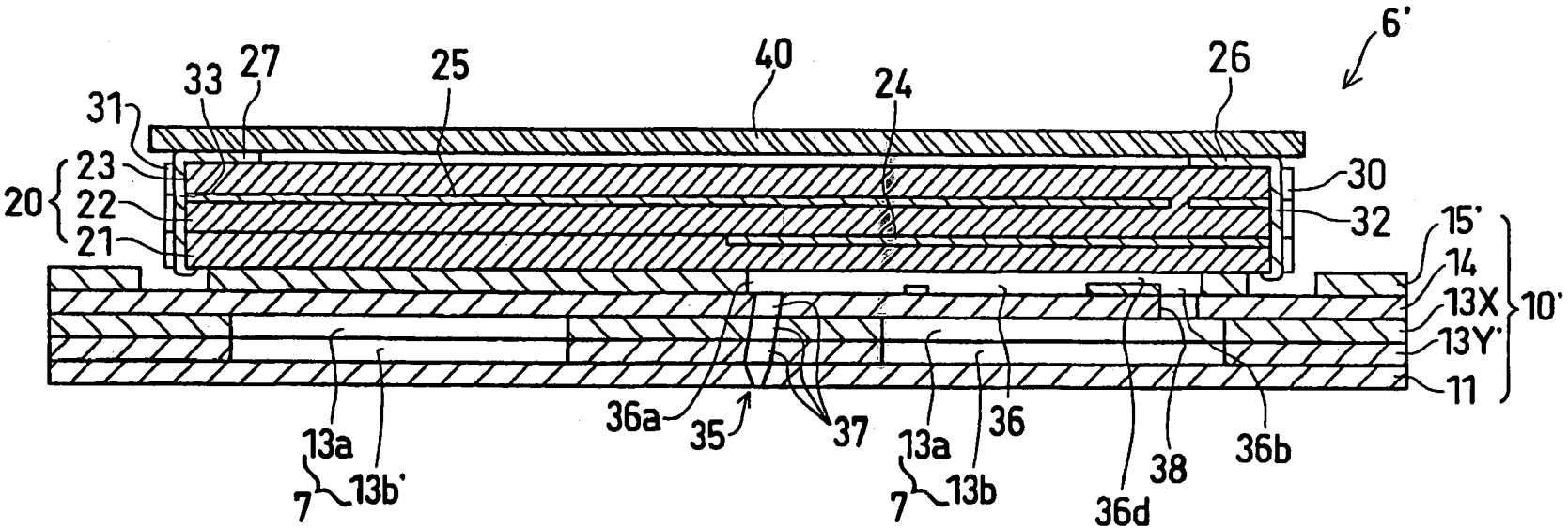
FIG. 19 is a sectional view showing a structure of a passage of the ink-jet head of the second embodiment.

FIGS. 17 to 19 show an ink-jet head 6' of a second embodiment. In the ink-jet head 6', its passage unit 10' has a structure in which five flat plates in total, that is, a nozzle plate 11, two manifold plates 13X and 13Y', a spacer plate 14, and a base plate 15' are laminated. That is, the damper plate 12 in the first embodiment is omitted. Since the structure of the nozzle plate 11, the upper manifold plate 13X, and the spacer plate 14 are quite equal to the first embodiment, their description will be omitted.

In the lower manifold plate 13Y', two ink chamber half parts 13*b*' and 13*b*' are provided to pass through a plate thickness, not to be concave. The four flat plates, that is, the spacer plate 14, the upper manifold plate 13X, the lower manifold plate 13Y', and the nozzle plate 11 are laminated, so that the ink chamber half part 13*b*' is connected to the ink chamber half part 13*a* of the upper manifold plate 13X, and the common ink chamber 7 is formed as shown in FIG. 19.

As shown in FIG. 18, a plurality of pressure chambers 36, 36, . . . are bored in the base plate 15' in two rows in a staggered arrangement along the longitudinal direction of the base plate 15'. Each of the pressure chambers 36 is formed to have a thin width so that its longitudinal direction is orthogonal to the longitudinal direction of the base plate 15'. Besides, as shown in FIGS. 18 and 19, throttle parts 36*d* connected to the pressure chambers 36, and ink introduction holes 36*b* connected to the throttle parts 36*d* are concavely provided at the side of the base plate 15' facing an actuator 20.

Also in the ink-jet head 61 of the second embodiment as stated above, the structure as shown in FIGS. 12 to 16 can be similarly applied to the connection portions between the common ink chamber 7 and the ink supply holes 38. As a result, the discharge property of air bubbles in the common ink chamber 7 is improved, and it is possible to prevent a trouble, such as non-ejection of ink due to air bubbles, from occurring.

In both the first embodiment and the second embodiment, as the actuator 20, in addition to one that gives the ejection pressure to the ink in the pressure chambers 36 by piezoelectricity or electrostrictive deformation as described above, one that gives the ejection force to the ink by using force of static electricity, magnetism, local boiling of ink by heat, or the like can also be used.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

We claim:

1. An ink-jet head comprising:

a plurality of nozzles for ejecting ink;

a plurality of pressure chambers provided correspondingly to the respective nozzles and connected to the nozzles;

a common ink chamber for distributing and supplying ink to the pressure chambers;

a supply passage for supplying the ink to the common ink chamber;

a plurality of connection passages provided correspondingly to the respective pressure chambers, one ends of which are connected to the common ink chamber and the other ends of which are connected to the respective pressure chambers;

a first member forming the common ink chamber; and a second member connected to the first member and having openings of the connection passages formed to be aligned in a surface at a side of the first member, wherein an opening among the openings, which is positioned at a most downstream end of the common ink chamber in a flowing direction of the ink through the supply passage, straddles a contour of the common ink chamber of the first member at the most downstream end of the common ink chamber, such that the first member projects over the opening.

2. An ink-jet head according to claim 1, wherein an opening area of the opening positioned at the most downstream end in the flowing direction of the ink from the supply passage in the common ink chamber is largest among the openings.

3. An ink-jet head according to claim 1, wherein a wall part of the common ink chamber partially overlaps with all the openings constituting the openings.

4. An ink-jet head comprising:

a plurality of nozzles for ejecting ink;

a plurality of pressure chambers provided correspondingly to the respective nozzles and connected to the nozzles;

a slender common ink chamber for distributing and supplying ink to the pressure chambers;

a plurality of connection passages provided correspondingly to the respective pressure chambers, one ends of which are connected to the common ink chamber and the other ends of which are connected to the respective pressure chambers;

a first member forming the common ink chamber; and a second member being adjacent to the first member and having openings of the connection passages formed to be aligned in a surface at a side of the first member, wherein when the first member and the second member are connected to each other, an opening positioned at one end of the common ink chamber in an alignment direction of the openings is partially covered by an area of the first member forming an end of the common ink chamber in a longitudinal direction.

5. An ink-jet head according to claim 4, wherein an opening area of the opening positioned at the end in the alignment direction is largest among the openings.

6. An ink-jet head according to claim 4, wherein when the first member and the second member are connected to each other, all the openings are partially closed by an area of the first member forming a wall part of the common ink chamber.

7. An ink-jet head comprising:

a plurality of nozzles for ejecting ink;

a plurality of pressure chambers provided correspondingly to the respective nozzles and connected to the nozzles;

a common ink chamber for distributing and supplying ink to the pressure chambers;

a supply passage for supplying the ink to the common ink chamber;

a plurality of connection passages provided correspondingly to the respective pressure chambers, one ends of which are connected to the common ink chamber and the other ends of which are connected to the respective pressure chambers;

a first member forming the common ink chamber; and a second member being adjacent to the first member and having openings of the connection passages formed to be aligned in a surface at a side of the first member, wherein among the openings, only a part of an opening positioned at a most downstream end of the common ink chamber in a flowing direction of the ink through the supply passage and at one side in an alignment direction faces the most downstream end of the common ink chamber.

8. An ink-jet head according to claim 7, wherein an opening area of the opening positioned at the most downstream end in the flowing direction of the ink from the supply passage in the common ink chamber is largest among the openings.

9. An ink-jet head according to claim 7, wherein only a part of each of all the openings faces the common ink chamber.

* * * * *